US010870907B2

(12) United States Patent
Ido et al.

(10) Patent No.: US 10,870,907 B2
(45) Date of Patent: Dec. 22, 2020

(54) ELEMENT FOR SLIDE FASTENER

(71) Applicants: YKK Corporation, Tokyo (JP); National University Corporation University of Toyama, Toyama (JP)

(72) Inventors: Tatewaki Ido, Toyama (JP); Tetsuya Katsumi, Toyama (JP); Koichi Mikado, Toyama (JP); Yasuharu Yoshimura, Toyama (JP); Kenji Matsuda, Toyama (JP)

(73) Assignees: YKK Corporation; National University Corporation University of Toyama

( * ) Notice: Subject to any disclaimer, the term of this patent is extended or adjusted under 35 U.S.C. 154(b) by 151 days.

(21) Appl. No.: 15/765,668

(22) PCT Filed: Sep. 20, 2016

(86) PCT No.: PCT/JP2016/077732
§ 371 (c)(1),
(2) Date: Apr. 3, 2018

(87) PCT Pub. No.: WO2017/061269
PCT Pub. Date: Apr. 13, 2017

(65) Prior Publication Data

US 2019/0085430 A1 Mar. 21, 2019

(30) Foreign Application Priority Data

Oct. 8, 2015 (JP) ..... 2015-200519

(51) Int. Cl.
*C22C 21/14* (2006.01)
*C22C 21/16* (2006.01)
(Continued)

(52) U.S. Cl.
CPC ..... *C22C 21/14* (2013.01); *A44B 19/02* (2013.01); *C22C 21/08* (2013.01); *C22C 21/16* (2013.01);
(Continued)

(58) Field of Classification Search
CPC ..... C22C 21/14; C22C 21/16
See application file for complete search history.

(56) References Cited

U.S. PATENT DOCUMENTS

2004/0163739 A1 8/2004 Kawazoe et al.
2018/0049520 A1* 2/2018 Fukuyama ..... A44B 19/02
2019/0085430 A1* 3/2019 Ido ..... C22C 21/08

FOREIGN PATENT DOCUMENTS

CN 101280400 A 10/2008
CN 104328314 A 2/2015
(Continued)

OTHER PUBLICATIONS

Office Action, Chinese Patent Application No. 201680058503.1, dated May 30, 2019.
(Continued)

*Primary Examiner* — Scott R Kastler
(74) *Attorney, Agent, or Firm* — Kilpatrick Townsend & Stockton LLP

(57) ABSTRACT

Provided is an aluminum alloy element for a slide fastener, which has improved strength and abrasion resistance. The element for the slide fastener includes a base material of an aluminum alloy having a composition represented by a general formula: $Al_aSi_bCu_cMg_dTi_eB_f$ in which a, b, c, d, e and f each represents % by mass; a is a balance; $0.2 \leq b \leq 0.8$, $0.8 \leq c \leq 1.8$, $0.8 \leq d \leq 1.8$, $0 < e \leq 0.05$, and $0 < f \leq 0.01$; and unavoidable impurity elements may be contained; the aluminum alloy comprising, dispersed therein, precipitates containing at least one element selected from a group consisting
(Continued)

of Al, Si, Cu and Mg, the element for the slide fastener comprising a pair of leg portions and a head portion that connects the pair or leg portions and comprises a convex portion and a concave portion for engagement.

11 Claims, 3 Drawing Sheets

(51) Int. Cl.

| | |
|---|---|
| ***A44B 19/02*** | (2006.01) |
| ***C22F 1/047*** | (2006.01) |
| ***C22F 1/057*** | (2006.01) |
| ***C22C 21/08*** | (2006.01) |
| *C22F 1/00* | (2006.01) |

(52) U.S. Cl.
CPC ..... *C22F 1/047* (2013.01); *C22F 1/057* (2013.01); *C22F 1/00* (2013.01)

(56) References Cited

FOREIGN PATENT DOCUMENTS

| | | | |
|---|---|---|---|
| JP | 10-8172 | A | 1/1998 |
| JP | 2000-303157 | A | 10/2000 |
| JP | 2004-250760 | A | 9/2004 |
| JP | 2006-291298 | A | 10/2006 |

OTHER PUBLICATIONS

Li, "Aluminum-Titanium-Boron High Efficiency Grain Refiner", Light Alloy Processing Technology, May 1989, p. 47.
International Preliminary Report on Patentability, PCT International Patent Application No. PCT/JP2016/077732, dated Apr. 19, 2018.
International Search Report, PCT Patent Application No. PCT/JP2016/077732, dated Nov. 29, 2016.

* cited by examiner

ELEMENT FOR SLIDE FASTENER

TECHNICAL FIELD

The present invention relates to a slide fastener, and more particularly to elements for slide fasteners.

BACKGROUND ART

Conventionally, copper-zinc alloys such as red brass and brass, and copper-zinc-nickel alloys such as nickel silver are mainly used for constituent parts of slide fasteners, for example. These alloys have colors specified by materials used, such as copper color, gold color and silver color. Recently, improved appearance design has been required for the slide fasteners in terms of their applications to be used, and there has been a need for parts having various colors.

On the other hand, slide fasteners having various colors are known, such as those obtained by subjecting elements (teethes) made of aluminum or an alloy thereof to an electrochemical surface treatment such as an anodizing treatment, electroplating and electrodeposition coating.

However, the electrochemical surface treatment to the existing aluminum alloy (for example, JIS 5183 and the like) tends to result in elements for slide fasteners which have various colors with poor metallic luster, and when the alloy composition is adjusted so as to focus on metallic glossiness or when the existing aluminum alloy (for example, JIS 5052, 5056, 5154, and the like) is selected, mechanical properties required for intended use, in particular strength, are deteriorated, so that practical restraint will occur.

Patent Document 1 discloses an aluminum alloy with improved decorativeness. The aluminum alloy has a composition represented by the general formula $Al_aMg_bMn_cCr_d$ in which a, b, c and d each represents % by mass, a represents the balance, with $3.0 \le b \le 5.6$, $0.05 \le c \le 1.0$, $0.05 \le d \le 0.7$, and $c+d>0.2$, and unavoidable impurity elements may be contained. The alloy has a matrix substantially consisting of a solid solution of aluminum and has no β phase. This document also discloses that slide fastener parts obtained from the alloy have mechanical properties such as strength and hardness.

Patent Document 2 discloses at least one type selected from the group consisting of components, elements, fasteners, pull tabs and sliders for slide fasteners made of the following four aluminum alloys:

(1) an aluminum alloy having a composition represented by the general formula: $Al_aMg_bCu_c$ in which a, b and c each represents % by mass, a is the balance, $4.3 \le b \le 5.5$ and $0.5 \le c \le 1.0$, and unavoidable impurities may be contained;

(2) an aluminum alloy having a composition represented by the general formula: $Al_dMg_eCu_fX_g$ in which X is Mn and/or Cr, and d, e, f and g each represents % by mass, and d is the balance, $4.3 \le e \le 5.5$, $0.5 \le f \le 1.0$, and $0.05 < g \le 0.2$, and unavoidable impurities may be contained;

(3) an aluminum alloy having a composition represented by the general formula: $Al_hMg_iCu_jZn_k$ in which h, i, j and k each represents % by mass, and h is the balance, $4.3 \le i \le 5.5$, $0.5 \le j \le 1.0$, $0 < k \le 1.0$, and unavoidable impurities may be contained; and further satisfying the relational expression: $j+k \le 1.5$;

(4) an aluminum alloy having a composition represented by the general formula: $Al_lMg_mCu_nZn_pX_q$ in which X is Mn and/or Cr, and l, m, n, p and q each represents % by mass, and l is the balance, $4.3 \le m \le 5.5$, $0.5 \le n \le 1.0$, $0 < p \le 1.0$, and $0.05 < q \le 0.2$, and avoidable impurities may be contained; and further satisfying the relational expression: $n+p \le 1.5$.

CITATION LIST

[Patent Document 1] Japanese Patent Application Publication No. 2004-250760A

[Patent Document 2] Japanese Patent Application Publication No. 2006-291298 A

SUMMARY OF INVENTION

Technical Problem

The elements for the slide fasteners using the conventional aluminum alloy do not have sufficient strength, so that it is difficult to use them at a position where the strength will be required, for example for pants. Further, abrasion by the slider or friction between the elements may generate black abrasion powders, thereby leading to fouling of the clothing and the like. Furthermore, an increased amount of wear weakens the engagement between the elements, so that the chain crosswise strength of the elements is also decreased. Therefore, there is still room for improvement.

The aluminum alloys described in Patent Documents 1 and 2 are of solid solution strengthening type. Therefore, there has been a problem that if the strength is improved by increasing the amount of solid solution and by cold rolling, the workability is decreased, and strain removal by a heat treatment during processing is required for obtaining the element shape, so that the strength is decreased.

Therefore, an object of the present invention is to provide aluminum alloy elements for slide fasteners, which have improved strength and abrasion resistance.

Solution to Problem

As a result of intensive investigation by the present inventors to achieve the above object, the present inventors has been found that an element having excellent strength and abrasion resistance can be obtained by using an age hardening type aluminum alloy having a predetermined composition in place of the conventional aluminum alloy in which a main reinforcing mechanism is solid solution strengthening, and carrying out suitable producing steps, and the present invention has been then completed. In the present invention, the strength and abrasion resistance are improved by increasing a composition ratio of Cu. However, originally, when the composition ratio of Cu is increased, the cold workability would be deteriorated, so that the processing into the element shape would be difficult. However, as will be described below, the present inventors has succeeded in producing an age hardening type aluminum alloy element having a higher Cu concentration by optimizing a range of the composition including Mg and Si and improving the production processes.

In one aspect, the present invention relates to an element for a slide fastener, the element comprising a base material of an aluminum alloy having a composition represented by a general formula: $Al_aSi_bCu_cMg_dTi_eB_f$ in which a, b, c, d, e and f each represents % by mass; a is a balance; $0.2 \le b \le 0.8$, $0.8 \le c \le 1.8$, $0.8 \le d \le 1.8$, $0 < e \le 0.05$, and $0 < f \le 0.01$; and unavoidable impurity elements may be contained; the aluminum alloy comprising, dispersed therein, precipitates containing at least one element selected from a group consisting of Al, Si, Cu and Mg, the element for the slide fastener comprising a pair of leg portions and a head portion that connects the pair or leg portions and comprises a convex portion and a concave portion for engagement.

In one embodiment of the element for the slide fastener according to the present invention, the leg portions have an average Vickers hardness of from Hv 140 to Hv 170 in a leg base portion that is a region of the leg portions corresponding to 50% of a length from a base of the leg portions, the length being a length of a perpendicular line drawn from the base of the leg portions toward the tip of the leg portions.

In another embodiment of the element for the slide fastener according to the present invention, the leg portions have an average Vickers hardness of from Hv 145 to Hv 170 in a leg base portion that is a region of the leg portions corresponding to 50% of a length from a base of the leg portions, the length being a length of a perpendicular line drawn from the base of the leg portions toward the tip of the leg portions.

In yet another embodiment of the element for the slide fastener according to the present invention, the leg portions have an average Vickers hardness of from Hv 150 to Hv 170 in a leg base portion that is a region of the leg portions corresponding to 50% of a length from a base of the leg portions, the length being a length of a perpendicular line drawn from the base of the leg portions toward the tip of the leg portions.

In yet another embodiment of the element for the slide fastener according to the present invention, the head portion has an average Vickers hardness of from Hv 140 to Hv 170.

In yet another embodiment of the element for the slide fastener according to the present invention, a difference between an average Vickers hardness in a leg base portion and an average Vickers hardness of the head portion is within 10, the leg base portion being a region of the leg portion corresponding to 50% of a length from a base of the leg portions, the length being a length of a perpendicular line drawn from the base of the leg portions toward the tip of the leg portions.

In yet another embodiment of the element for the slide fastener according to the present invention, when observing a cross section from a direction of viewing both of the pair of leg portions and the head portion, an average aspect ratio of crystal grains in a leg base portion is 5.1 or more, the leg base portion being a region of the leg portions corresponding to 50% of a length from a base of the leg portions, the length being a length of a perpendicular line drawn from the base of the leg portions toward the tip of the leg portions.

In yet another embodiment of the element for the slide fastener according to the present invention, the precipitates comprise at least one type selected from a group consisting of Al-Cu-Mg-based, Mg-Si-based and Al-Cu-Mg-Si-based precipitates.

In yet another embodiment of the element for the slide fastener according to the present invention, among the precipitates, the Al-Cu-Mg-based precipitates account for the highest content.

In another aspect, the present invention relates a slide fastener comprising the element for the slide fastener according to the present invention.

In yet another aspect, the present invention relates to an article comprising the slide fastener according to the present invention.

Advantageous Effects of Invention

According to the present invention, it is possible to provide an element for an aluminum alloy slide fastener having improved strength and abrasion resistance. Therefore, it is possible to provide a slide fastener having excellent mechanical properties in addition to lightness and a design property which are characteristics of the aluminum alloy. For example, the present invention will contribute to enabling to propose fastener products with a wide variety of lineups to users, for the reasons that the aluminum alloy will be capable of being employed for the slide fasters for pants in which only red brass could be conventionally used due to the requirement of higher strength, and the like.

DESCRIPTION OF THE PREFERRED EMBODIMENTS (Composition)

Figure 1:
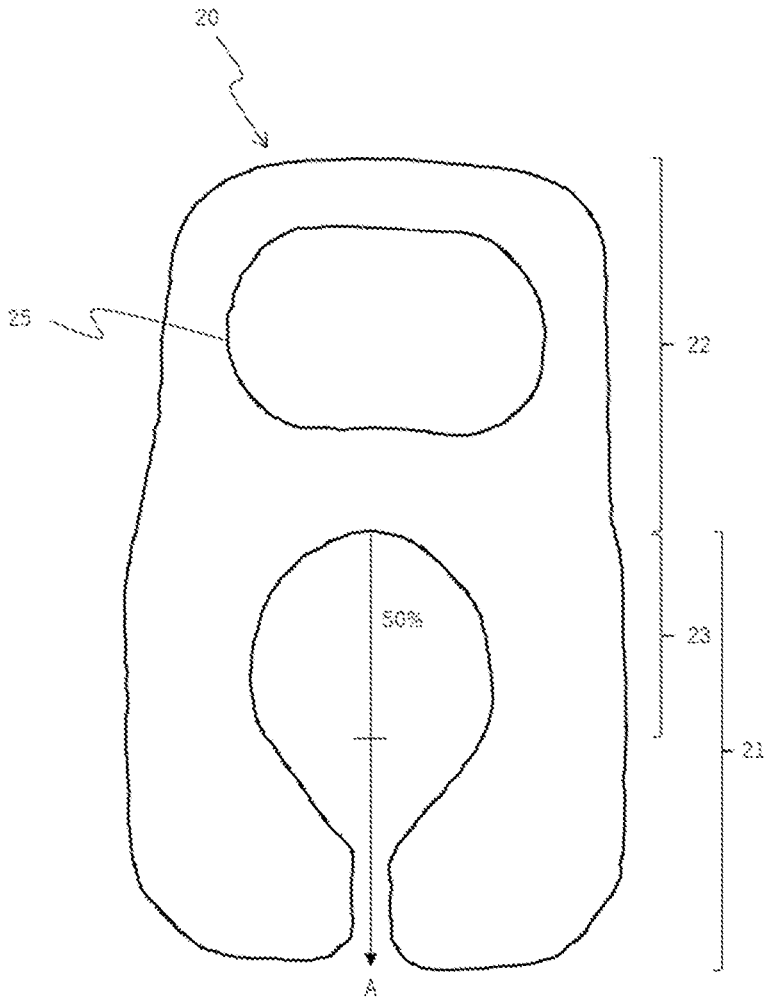
FIG. 1 is an example of a photograph of a cross section of an element observed from a direction of viewing both of a pair of leg portions and a head portion.

The element for the slide fastener according to the present invention aims at having higher strength and improved wear resistance by forming a base material from an age hardening type aluminum alloy. The specific composition of the base material is as follows:

In one embodiment, the element for the slide fastener according to the present invention includes a base material of an aluminum alloy which has a composition represented by the general formula: $Al_aSi_bCu_cMg_dTi_eB_f$ in which a, b, c, d, e and f each represents % by mass; a is the balance; $0.2 \le b \le 0.8$, $0.8 \le c \le 1.8$, $0.8 \le d \le 1.8$, $0 < e \le 0.05$ and $0 < f \le 0.01$; and unavoidable impurity elements may be contained. In the aluminum alloy, precipitates containing at least one element selected from a group consisting of Al, Si, Cu and Mg are dispersed.

<Si>

Si has an effect of forming an extremely fine intermetallic compound mainly with Mg by dissolving in an Al matrix and then performing an aging heat treatment, so that mechanical properties (strength, hardness) of the alloy are improved.

A composition ratio (b) of Si is set to be 0.2 (% by mass)≤b≤0.8 (% by mass), i.e., 0.2% by mass or more and 0.8% by mass or less. The composition ratio of Si may preferably be 0.2% by mass or more, and more preferably 0.3% by mass or more, in terms of improving the strength of the aluminum alloy. On the other hand, if the composition ratio of Si is too high, coarse precipitation or crystallization of Si alone will be promoted and elongation due to plastic deformation will be decreased, thereby deteriorating the workability. Therefore, the composition ratio of Si may preferably be 0.8% by mass or less, and more preferably 0.5% by mass or less. Further, the addition of an appropriate amount of Si provides an advantage of allowing prevention of softening in a heating step (water washing, drying, and the like) after cold working. In particular, the atoms (Si) precipitated in the Al matrix by the aging heat treatment serve to prevent movement of dislocations introduced by the cold rolling, so that reduction of strength due to the heat treatment can be suppressed.

<Cu>

Cu has an effect of forming extremely fine precipitates represented by Al-Cu-Mg- and Al-Cu-Mg-Si-based precipitates by dissolving in the Al matrix and then performing the aging heat treatment, so that the mechanical properties (strength, hardness) of the alloy are improved.

A composition ratio (c) of Cu is set to be 0.8 (% by mass)≤c≤1.8 (% by mass), i.e., 0.8% by mass or more and 1.8% by mass or less. The composition ratio of Cu may preferably be 0.8% by mass or more, and more preferably 1.0% by mass or more, and even more preferably 1.2% by mass or more, in terms of improving the strength of the aluminum alloy. However, if Cu is added in an amount of more than 1.8% by mass, the cold workability will be drastically decreased. Therefore, the composition ratio of Cu may preferably be 1.8% by mass or less. Further, the addition of an appropriate amount of Cu provides an advantage of allowing prevention of softening during a heating step (water washing, drying, and the like) after the cold working. In particular, the atoms (Cu) precipitated in the Al matrix by the aging heat treatment serve to prevent movement of dislocations introduced by the cold rolling, so that reduction of strength due to the heat treatment can be suppressed.

One of the features of the present invention is that the strength is drastically improved by increasing the Cu content. The increased content of Cu contributes to improvement of the strength. However, if Cu is added in a composition ratio as high as 0.8% by mass or more as in the present invention, the material will typically become too hard during the producing processes of the element, so that cracks will be generated. However, the improvement of the producing processes of the element as described below allows the production of the aluminum alloy elements having higher strength by containing such a higher concentration of Cu.

<Mg>

Mg has an effect of forming extremely fine intermetallic compounds represented by Al-Cu-Mg-based, Mg-Si-based and Al-Cu-Mg-Si-based compounds by performing the aging heat treatment, resulting in improvement of the mechanical properties (strength, hardness). Mg also has an effect of improving the mechanical properties (strength, hardness) of the alloy by dissolving in Al, which is the matrix.

In the present invention, a composition ratio (d) of Mg is set to be 0.8 (% by mass)≤d≤1.8 (% by mass), i.e., 0.8% by mass or more and 1.8% by mass or less. As described below, a sufficient amount of Mg is required relative to Cu and Si, because Mg may be a constituent element for all assumed precipitates such as $Al_2CuMg$, $Mg_2Si$ and $Al_4Cu_2Mg_8Si_7$. Therefore, the composition ratio (d) of Mg is set to be 0.8% by mass or more, and preferably 1.0% by mass or more. On the other hand, since the effect of improving the hardness is limited even if the composition ratio of Mg is excessively increased, the composition ratio (d) of Mg is set to be 1.8% by mass or less, and preferably 1.2% by mass or less. Further, the addition of an appropriate amount of Mg allows prevention of softening during the heating step (water washing, drying, and the like) after the cold working. In particular, the atoms (Mg) precipitated in the Al matrix by the aging heat treatment serve to prevent movement of dislocations introduced in the cold rolling, so that reduction of strength due to the heat treatment can be suppressed.

<Ti, B>

The addition of a small amount of Ti and B provides an effect of improving the cold workability. Although the present invention is not intended to be limited by any theory, the effect would be produced by the following mechanism. A compound of titanium and boron such as $TiB_2$ is formed and the compound renders crystal grains fine during casting, thereby improving the cold workability. On the contrary, if the crystal grains are not rendered fine, the crystal grains grown in the form of dendrite and coarsened crystal grains will be increased, which increases the possibility of coarse crystals appearing between the dendrites. The crystals cause cracks during the cold working. The addition of a minute amount of Ti and B is particularly effective when containing the higher concentration of Cu as in the present invention. In the present invention, a composition ratio (e) of Ti is set to be 0 (% by mass)<e≤0.05 (% by mass), i.e., more than 0% by mass and 0.05% by mass or less. A preferable composition ratio of Ti may be 0.01% by mass or more. However, as the composition ratio of Ti increases, coarse crystals will be formed, and conversely the strength may be decreased. Therefore, the composition ratio of Ti may preferably be 0.05% by mass or less, and more preferably 0.03% by mass or less. Further, a composition ratio (f) of B is set to be 0 (% by mass)<f≤0.01 (% by mass), i.e., more than 0% by mass and 0.01% by mass or less. A preferable composition ratio of B may be 0.001% by mass or more, and more preferably 0.002% by mass or more. However, as the composition ratio of B increases, coarse crystals will be produced, and conversely, the strength may be decreased. Therefore, the composition ratio of B may preferably be 0.01% by mass or less, and more preferably 0.005% by mass or less.

<Unavoidable Impurities>

The unavoidable impurities refer to impurities which may be present in raw materials or inevitably mixed during producing steps and which are inherently unnecessary, but acceptable because they are present in a miner amount and have no effect on properties. In the present invention, the content of each impurity element that is acceptable as the unavoidable impurities is generally 0.1% by mass or less, and preferably 0.05% by mass or less. It should be noted that in the present invention, Fe, Mn Cr and Zr also correspond to the unavoidable impurities, but they have no adverse effect even if the contents thereof are higher than those of other impurities. Acceptable amount for Fe is 0.7% by mass or less, Mn is 0.15% by mass or less, Cr is 0.35% by mass or less, and Zn is 0.25% by mass or less.

(Mechanical Properties)

Referring to FIG. 1, it shows an example of a photograph when a cross section of an element 20 for a slide fastener is observed from the direction of viewing both of a pair of leg portions 21 and a head portion 22. The cross section is obtained by removing a thickness of about 0.1 mm from the appearance surface by polishing and corrosion treatments. The element 20 for the slide fastener generally includes the pair of leg portions 21 for holding a fastener tape and the head portion 22 connecting the pair of leg portions 21 and having a convex region 25 and a concave region (not shown) for engagement. Although the concave region is not shown, it can be formed on the back side of the convex region 25.

In one embodiment of the slide fastener according to the present invention, the leg portions have an average Vickers hardness of from Hv 140 to Hv 170 (according to JIS 2244: 2009; the same will apply hereinafter) in a leg base portion that is a region of the leg portions corresponding to 50% of a length from a base of the leg portions, the length being a length of a perpendicular line drawn from the base of the leg portions toward the tip of the leg portions. In addition, the leg base portion will be illustrated below while describing an aspect ratio of crystal grains, with reference to FIG. 1. By having such a higher Vickers hardness, the element will have improved wear resistance as well as withstand use in areas requiring higher strength, such as in pants. The average Vickers hardness of the leg base portion may preferably be Hv 145 or more, and more preferably Hv 150 or more, and still more preferably Hv 155 or more, and even more preferably Hv 160 or more.

In one embodiment of the slide fastener element according to the present invention, the head portion can have an average Vickers hardness of Hv 140 or more and Hv 170 or less. Since the head portion is susceptible to friction by engagement with the opposing element, it is advantageous to have such a higher Vickers hardness. The average Vickers hardness of the head portion may preferably be Hv 145 or more, and more preferably Hv 150 or more, and still more preferably Hv 155 or more, and even more preferably Hv 160 or more. It should be noted that when measuring the Vickers hardness of the head portion, the convex portion and concave portion as described above are excluded from the target for measurement. This is to make it possible to automatically measure the Vickers hardnesses of the leg and head portions of the element at the same time by the same plane mapping. However, the Vickers hardnesses in the convex region and the concave region can be substantially the same as hardnesses of portions other than those portions.

Thus, the element for the slide fastener according to the present invention can have high strength in both of the leg base portion and the head portion, and in one embodiment, a difference between the average Vickers hardness of the leg base portion and the average Vickers hardness of the head portion may be within 10, within 8, within 6, for example in the range of 1 to 10. The equivalent hardness of the leg base portion and the head portion will also provide an advantage that the portion with lower hardness is less likely to be locally deformed or broken.

(Aspect Ratio of Crystal Grain)

In an embodiment of the element for the slide fastener according to the present invention, the crystal grain has an elongated shape because the element is produced via cold working with a high working ratio. The elongated crystal grain indicates that the strength is increased by work hardening. In particular, the crystal grain in the leg portions, which are the parts for holding the fastener tape may preferably have the elongated shape, in terms of improving pull-out strength of the element.

In this regard, when removing the thickness of about 0.1 mm by subjecting an observation surface to polishing and corrosion treatments to expose a cross section and observing the cross section from the direction of viewing both of the pair of leg portions 21 and the head portion 22, the element 20 for the slide fastener according to the present invention illustrated in the photograph of FIG. 1 may have, in one embodiment, an average aspect ratio of crystal grains of 5.1 or more, and more preferably 5.4 or more, and even more preferably 5.5 or more, and still more preferably 6.0 or more, and even more preferably 8.0 or more, and further more preferably 9.0 or more, for example from 5.1 to 21.5, in the leg base portion 23. The leg base portion 23 is a region of the leg portions 21 corresponding to 50% of a length from a base of the leg portions 21, the length being a length of a perpendicular line drawn from the base of the leg portions 21 toward the tip of the leg portions 21.

Here, the aspect ratio of the crystal grain refers to a ratio of a long side length of the crystal grain to a short side length of the crystal grain, and the average aspect ratio of the crystal grains refers to an arithmetic average of the aspect ratios of a plurality of crystal grains. Here, the long side length of the crystal grain refers to a diameter of a minimum circle capable of surrounding the crystal grain to be measured, and the short side length of the crystal grain refers to a diameter of a maximum circle capable of being surrounded by the crystal grain. In one embodiment of the element for the slide fastener according to the present invention, the crystal grains in the leg base portions can be arrayed in the form of layer along the direction from the base to the tip of the leg portions.

(Morphology of Precipitate)

In one embodiment of the element for the slide fastener according to the present invention, precipitates containing at least one element selected from Al, Si, Cu and Mg are dispersed in the matrix. The alloy elements forming intermetallic compounds can be precipitated by an aging heat treatment. As the precipitates interfere with movement of dislocations due to a pinning effect, the mechanical properties of the aluminum alloy are improved.

In one embodiment of the element for the slide fastener according to the present invention, the precipitates include at least one type of precipitates selected from Al-Cu-Mg-based, Mg-Si-based and Al-Cu-Mg-Si-based precipitates. Typically, the Al-Cu-Mg-based precipitates accounts for the highest content, among others. The Al-Cu-Mg-based precipitates include $Al_2CuMg$, the Mg-Si-based precipitates include $Mg_2Si$, and the Al-Cu-Mg-Si-based precipitates include $Al_4Cu_2Mg_8Si_7$.

(Production Method)

The element for the slide fastener according to the present invention can be produced by the following procedure, for example. First, an aluminum alloy rod material having the above composition is produced by melting and casting. After sufficiently dissolving the alloy elements in the aluminum matrix by a solution treatment, a working strain with a predefined reduction rate is introduced by cold rolling to produce a continuous deformed wire having a substantially Y-shaped cross section. Subsequently, precipitates are precipitated in the matrix by an aging heat treatment, and further the deformed wire is then subjected to various cold working processes such as cutting, pressing, bending and caulking to provide elements for the slide fastener having a predetermined shape and size. For production of the elements for the slide fastener according to the present invention, a final product shape may be preferably made without carrying out any heat treatment that may lower the material strength, such as stress relief annealing or tempering annealing, after cold rolling. Conventionally, the elements are processed into a desired shape while restoring workability, via the strain relief annealing or tempering annealing during the producing processes. However, such a heat treatment causes the lowering of the strength of the element finally obtained. Further, immediately before carrying out the cold rolling for producing a continuous deformed wire having a substantially Y-shaped cross section, it is desirable that the material is in a softened state which does not undergo work hardening or age hardening. The aluminum alloy rod materials are often commercially available in a state where they have been hardened by a heat treatment such as T8 treatment (JIS H0001) or the like. However, with such a hardened material, cracks may be generated or rolling may become difficult if elements are molded and processed from an aluminum alloy having a high composition ratio of Cu as in the present invention. The heat treatment to soften the material to facilitate the processing results in difficulty to obtain elements with improved mechanical properties (strength and abrasion resistance).

In order to obtain desired mechanical properties, the cold working may be preferably carried out at a rolling reduction rate of 70% or more when preparing the continuous deformed wire having the substantially Y-shaped cross section, and the subsequent aging treatment may be carried out to increase the strength, and the cold working may be then carried out at a working ratio corresponding to a rolling reduction rate of 80% or more by means of pressing, bending, caulking or the like. In this case, if the working strain is excessive, the hardness is excessively increased due to the work hardening. As a result, a lifetime of a mold will be reduced, and in some cases cracks are generated in the elements due to the processing limitation, so that the function as the element for the slide fastener is impaired. Therefore, it is desired to set the working ratio during the cold working to a range where cracks are not generated, depending on the alloy composition.

(Surface Treatment)

The elements for the slide fastener according to the present invention may be optionally subjected to various surface treatments. For example, the elements may be subjected to a smoothing treatment, a rust preventive treatment, a painting treatment, a plating treatment and the like.

(Slide Fastener)

Figure 2:
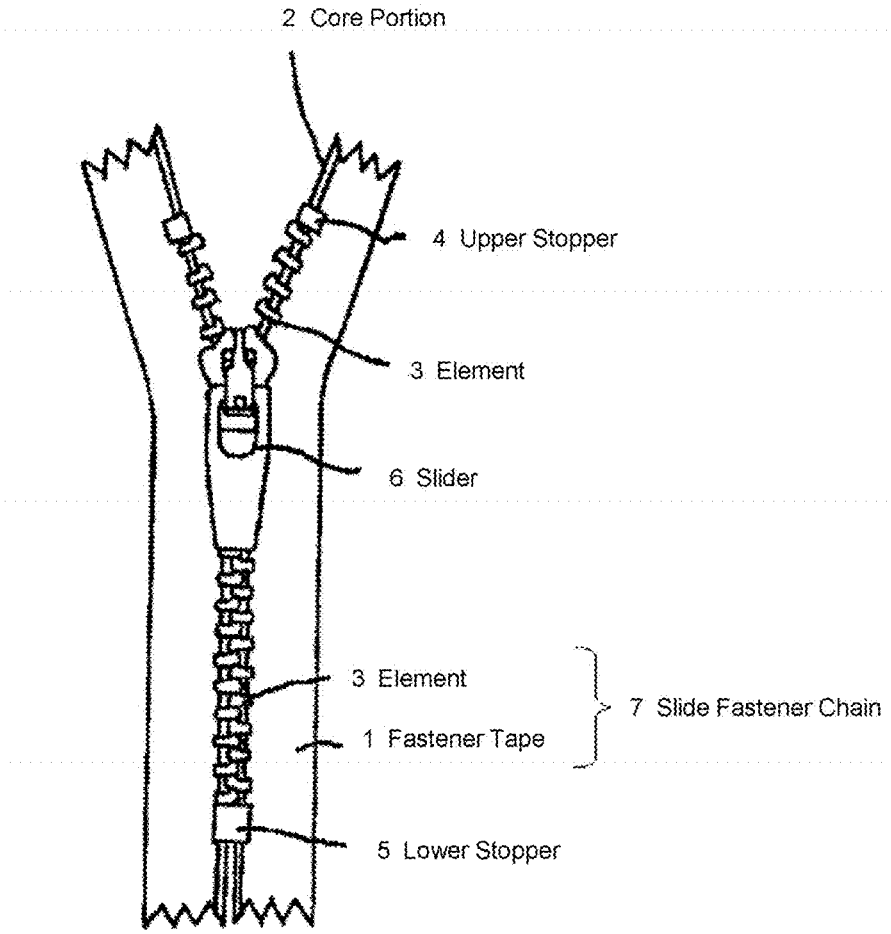
FIG. 2 is a schematic view of a slide fastener.

An example of the slider fastener provided with the elements for the slide fastener according to the present invention will be described with reference to Figures. FIG. 2 is a schematic view of the slide fastener. As shown in FIG. 2, the slide fastener includes a pair of fastener tapes 1 each having a core portion 2 formed on one side edge; elements 3 attached and fixed to the core portion 2 of each fastener tape 1 by means of caulking and arranged at a predetermined space; upper stoppers 4 and a lower stopper 5 fixed to the core portions 2 of the fastener tapes 1 by means of caulking at the upper end and the lower end of the elements 3; and a slider 6 arranged between a pair of opposing elements 3 and slidable in the up and down direction so as to engage and disengage the pair of the elements 3. An article in which the elements 3 have been attached on the core portion 2 of one fastener tape 1 is referred to as a slide fastener stringer, and an article in which the elements 3 attached to each of the core portions 2 of the pair of fastener tapes 1 have been engaged with each other is referred to as a slide fastener chain 7.

Further, the slider 6 shown in FIG. 2 is obtained by subjecting a long body (not shown) made of a plate-like body having a rectangular cross section to press working in multiple stages and cutting the long body at predetermined intervals to prepare a slider body, and further optionally attaching a spring and a pull tab to the slider body. Furthermore, the pull tab is obtained by punching the plate-like body having the rectangular cross section into a predetermined shape, and the pull tab is attached and fixed to the slider body by means of caulking. It is noted that the lower stopper 5 may be an openable, closable and fittingly insertable tool consisting of an insert pin, a box pin and a box body, so that the pair of slide fastener chains can be separated by separating operation of the slider.

Figure 3:
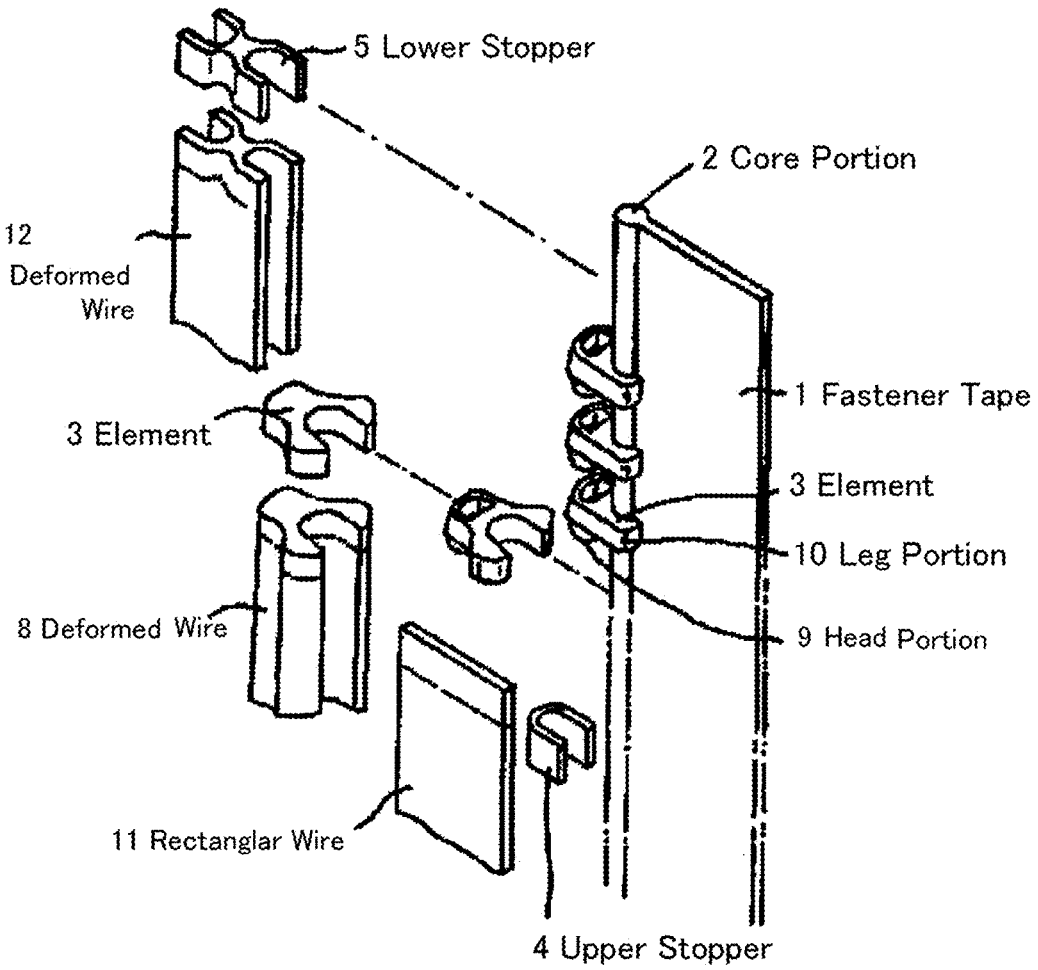
FIG. 3 is a view for explaining how to attach a lower stopper, an upper stopper and elements to a fastener tape.

FIG. 3 is a view showing a method for assembling the elements 3, the upper stopper 4 and the lower stopper 5 for the slide fastener as shown in FIG. 2 and how to attach these members to the core portion 2 of the fastener tape 1. As shown in FIG. 2, the elements 3 are formed by cutting a deformed wire 8 having a substantially Y-shaped cross section into pieces each having predetermined dimensions, and pressing the pieces to form a convex region and a concave region for engagement in a head portion 9, and are then attached to the core portion 2 by caulking both leg portions 10 onto the core portion 2 of the fastener tape 1.

The upper stopper 4 is formed by cutting a rectangular wire 11 having a rectangular cross section into pieces each having predetermined dimensions, and bending the pieces to form a substantially C-shaped cross section, and is then attached to the core portion 2 by caulking it onto the core portion 2 of the fastener tape 1. The lower stopper 5 is formed by cutting a deformed wire 12 having a substantially X-shaped cross section 12 into pieces each having predetermined dimensions, and is then attached to the core portion 2 by caulking it onto the core portion 2 of the fastener tape 1.

In addition, FIG. 3 shows that the elements 3, the upper stopper 4 and the lower stopper 5 are simultaneously attached to the fastener tape 1. However, actually, the elements 3 are first attached intermittently to predefined regions of the fastener tape 1 to form a fastener chain, and the upper or lower stopper 4, 5 is then attached in the region with no element in contiguity with the attached elements 3. Since the production and attachment are performed in such way, the elements and the stoppers as the slide fastener members should have good cold workability. In this regard, the metallic fastener members according to the present invention have good cold workability, and for example, they can be processed with a rolling reduction rate of 70% or more. Therefore, they are suitable as materials for the elements and the upper and lower stoppers.

The slide fastener according to the present invention can be attached to various articles, and particularly functions as an opening/closing tool. The articles to which the slide fastener is attached include, but not limited to, daily necessities such as clothes, bags, shoes and miscellaneous goods, as well as industrial goods such as water storage tanks, fishing nets and space suites.

EXAMPLES

Hereinafter, Examples of the present invention are illustrated, but they are provided for better understanding of the present invention and its advantages, and are not intended to limit the present invention.

Preparation of Fastener Chain Using Age Hardening Type Aluminum Alloy (Examples 1 to 6, Comparative Examples 1 to 5)

As raw materials, Al (purity of 99.99% by mass or more), Cu (purity of 99.9% by mass or more), Mg (purity of 99.9% by mass or more), Si (purity of 99.9% by mass or more), Ti (purity of 99.9% by mass or more) and B (purity of 99.9% by mass or more) were used. These raw materials were blended so as to have each alloy composition according to the test number as shown in Table 1, and melted in a casting machine, and a rod material was then produced by an extruder. The resulting rod material was subjected to a solution treatment at 545° C. for 1 hour, and then subjected to cold rolling to provide a working strains with a predefined rolling reduction rate to produce a continuous deformed wire having a substantially Y-shaped cross section, which was then subjected to an aging treatment at 170° C. for 2 hours. The continuous deformed wire was then subjected to various cold working processes such as cutting, pressing, bending and caulking to form elements each having the dimension of "5R" as defined in the catalog "FASTENING SENKA (issued by YKK Co., Ltd. on February 2009)". The elements were then attached to polyester fastener tapes to form fastener stringers. The opposing elements of a pair of fastener stringers were further engaged with each other to form a fastener chain. For test examples in which cracks were observed during the attaching, the fact is shown in Table 1.

Preparation of Fastener Chain Using Solution Hardening Type Aluminum Alloy (Comparative Example 6)

The same raw materials as described above were used. These raw materials were blended so as to have each component composition as shown in Table 1, dissolved in a casting apparatus and then subjected to Properzi process to provide a rod material. The resulting rod material was softened by strain relief annealing. The rod material was then subjected to a wire drawing treatment with an area reduction rate of 70% or more, and then further subjected to strain relief annealing (100° C.×3.5 hours). Subsequently, a working strain with a predefined reduction rate was provided by cold rolling to produce a continuous deformed wire having a substantially Y-shaped cross section, which was then subjected to tempering annealing at 100° C. for 3.5 hours. The continuous deformed wire was then subjected to various cold working processes such as cutting, pressing, bending and caulking to form elements each having the dimension of "5R" as defined in the catalog "FASTENING SENKA (issued by YKK Co., Ltd. on February 2009)". The elements were then attached to polyester fastener tapes to form fastener stringers. Further, the opposing elements of a pair of fastener stringers were engaged with each other to produce a fastening chain.

<Hardness Test>

Any one element was selected from the resulting fastener chain and a Vickers hardness (in accordance with JIS Z 2244: 2009 using a load of 0.9807 N) was measured at a plurality of positions of the leg base portion and the head portion by a micro Vickers hardness tester to obtain each average value. The results are shown in Table 1.

<Average Aspect Ratio of Crystal Grains in Leg Base Portion>

Any one element was selected from the resulting fastener chain and the element was attached into a resin such that the element could be observed from the direction of viewing both of the pair of leg portions and the engaging head portion. A thickness of about 0.1 mm was removed by mirror polishing to expose a cross section of the observation surface, and crystal grains were observed with SEM (Keyence Digital Microscope VHX-5000). The average aspect ratio of the crystal grains in the leg base portion was then determined by the method as described above. The results are shown in Table 1. For the element of each test example, the crystal grains in the leg base portion were arrayed in the form of layer along the direction from the base to the tip of the leg portion.

<Analysis of Precipitate>

Any one element was selected from the resulting fastener chain, from which a thin film specimen was prepared for TEM observation, and a selected area electron diffraction image (SAED) pattern was then taken using a transmission electron microscope (TEM) (H-7650 available from Hitachi High-Technologies Corporation). Based on the SAED pattern, the compositions of the precipitates dispersed in the matrix were analyzed, and the presence or absence of S phase: Al-Cu-Mg-based precipitates, β phase: Mg-Si-based precipitates, Q phase: Al-Cu-Mg-Si-precipitates, and the order of their abundance ratios were examined. The results are shown in Table 1.

<Workability Test>

The rod material having each component composition, prepared as stated above, was subjected to cold rolling at a predetermined rolling reduction rate and then subjected to an aging treatment at 170° C. for 2 hours. The cold rolling was then performed until cracks were generated, and the rolling reduction rate was measured at the time when the cracks were generated. In view of the processing of the Y-shaped continuous deformed wire into the element shape and the attaching to the fastener tape, it is desirable that the cold working with a rolling reduction rate of 88% or more is possible without causing the cracks. The results are shown in Table 1.

TABLE 1

| | | Example 1 | Example 2 | Example 3 |
|---|---|---|---|---|
| Composition | Cu, % by mass | 1.13 | 1.29 | 1.60 |
| | Mg, % by mass | 1.11 | 1.00 | 1.00 |
| | Si, % by mass | 0.42 | 0.39 | 0.37 |
| | Ti, % by mass | 0.019 | 0.019 | 0.019 |
| | B, % by mass | 0.004 | 0.004 | 0.004 |
| | Balance | Al and Unavoidable Impurities | Al and Unavoidable Impurities | Al and Unavoidable Impurities |
| Crystal Grains | Average Aspect Ratio | 10 | 10 | 10 |
| Precipitates | Mg—Si-based | Present (Abundance Ratio: 2th) | Present (Abundance Ratio: 2th) | Present (Abundance Ratio: 2th) |
| | Al—Cu—Mg-based | Present (Abundance Ratio: 1st) | Present (Abundance Ratio: 1st) | Present (Abundance Ratio: 1st) |
| | Al—Cu—Mg—Si-based | Present (Abundance Ratio: 3rd) | Present (Abundance Ratio: 3rd) | Present (Abundance Ratio: 3rd) |
| Strength | Average Hardness of Leg Base Portion (Hv) | 145 | 153 | 156 |
| | Average Hardness of Head Portion (Hv) | 144 | 153 | 155 |
| Workability | Rolling Reduction Rate at Generation of Crack | 90.3% | 88.7% | 88.7% |

| | | Example 4 | Example 5 | Example 6 |
|---|---|---|---|---|
| Composition | Cu, % by mass | 1.74 | 0.83 | 0.83 |
| | Mg, % by mass | 1.11 | 1.13 | 1.64 |
| | Si, % by mass | 0.41 | 0.65 | 0.40 |
| | Ti, % by mass | 0.018 | 0.018 | 0.017 |

TABLE 1-continued

| | | | | |
|---|---|---|---|---|
| | B, % by mass | 0.004 | 0.003 | 0.003 |
| | Balance | Al and Unavoidable Impurities | Al and Unavoidable Impurities | Al and Unavoidable Impurities |
| Crystal Grains | Average Aspect Ratio | 10 | 10 | 10 |
| Precipitates | Mg—Si-based | Present (Abundance Ratio: 2th) | Present (Abundance Ratio: 2th) | Present (Abundance Ratio: 2th) |
| | Al—Cu—Mg-based | Present (Abundance Ratio: 1st) | Present (Abundance Ratio: 1st) | Present (Abundance Ratio: 1st) |
| | Al—Cu—Mg—Si-based | Present (Abundance Ratio: 3rd) | Present (Abundance Ratio: 3rd) | Present (Abundance Ratio: 3rd) |
| Strength | Average Hardness of Leg Base Portion (Hv) | 158 | 150 | 142 |
| | Average Hardness of Head Portion (Hv) | 163 | 147 | 141 |
| Workability | Rolling Reduction Rate at Generation of Crack | 88.7% | 88.4% | 89.7% |

| | | Comparative Example 1 | Comparative Example 2 | Comparative Example 3 |
|---|---|---|---|---|
| Composition | Cu, % by mass | 0.76 | 2.07 | 0.69 |
| | Mg, % by mass | 1.03 | 1.05 | 1.95 |
| | Si, % by mass | 0.37 | 0.43 | 0.34 |
| | Ti, % by mass | 0.019 | 0.019 | 0.019 |
| | B, % by mass | 0.004 | 0.004 | 0.003 |
| | Balance | Al and Unavoidable Impurities | Al and Unavoidable Impurities | Al and Unavoidable Impurities |
| Crystal Grains | Average Aspect Ratio | 10 | 10 | 10 |
| Precipitates | Mg—Si-based | Present (Abundance Ratio: 2th) | Present (Abundance Ratio: 2th) | Present (Abundance Ratio: 2th) |
| | Al—Cu—Mg-based | Present (Abundance Ratio: 1st) | Present (Abundance Ratio: 1st) | Present (Abundance Ratio: 1st) |
| | Al—Cu—Mg—Si-based | Present (Abundance Ratio: 3rd) | Present (Abundance Ratio: 3rd) | Present (Abundance Ratio: 3rd) |
| Strength | Average Hardness of Leg Base Portion (Hv) | 139 | 172 | 137 |
| | Average Hardness of Head Portion (Hv) | 138 | 169 | 135 |
| Workability | Rolling Reduction Rate at Generation of Crack | 90.9% | 87.8% | 87.9% |
| | Remarks | Lower Hardness | Leg Breakage at Attaching | Leg Breakage at Attaching |

| | | Comparative Example 4 | Comparative Example 5 | Comparative Example 6 |
|---|---|---|---|---|
| Composition | Cu, % by mass | 0.85 | 1.61 | 0.1 or less |
| | Mg, % by mass | 0.66 | 1.00 | 4.5-5.6 |
| | Si, % by mass | 1.08 | 0.34 | 0.3 or less |
| | Ti, % by mass | 0.018 | — | — |
| | B, % by mass | 0.003 | — | — |
| | Balance | Al and Unavoidable Impurities | Al and Unavoidable Impurities | Al and Unavoidable Impurities |
| Crystal Grains | Average Aspect Ratio | 10 | 10 | 7 |
| Precipitates | Mg—Si-based | Present (Abundance Ratio: 2th) | Present (Abundance Ratio: 2th) | Non |
| | Al—Cu—Mg-based | Present (Abundance Ratio: 1st) | Present (Abundance Ratio: 1st) | Non |
| | Al—Cu—Mg—Si-based | Present (Abundance Ratio: 3rd) | Present (Abundance Ratio: 3rd) | Non |
| Strength | Average Hardness of Leg Base Portion (Hv) | 142 | Unmeasured | 124 |
| | Average Hardness of Head Portion (Hv) | 140 | Unmeasured | 124 |
| Workability | Rolling Reduction Rate at Generation of Crack | 86.3% | Unmeasured | 93.2% |
| | Remarks | Leg Breakage at Attaching | Leg Breakage at Attaching | Lower Hardness |

<Abrasion Test>

The fastener chains of Example 2 and Comparative Example 6 were subjected to repeated opening and closing operations with a reciprocating opening and closing load of L rank (9.8 N in the lateral direction; 6.9 N in the longitudinal direction), according to the method described in the "reciprocating opening and closing durability test" in JIS S3015: 2007. The testing was stopped when the elements were no longer able to be engaged or when cutting of the tape portion, cracking of the engaging portion of the element and/or falling out of the element were visually observed, in the middle of the testing, and the number of opening and closing at that time was defined as a measured value. As a result, in Example 2, 613 opening and closing operations could be performed, whereas in Comparative Example 6, only 169 opening and closing operations could be performed.

<Pull-Out Strength of Element>

The pull-out strength test of the element was carried out by disengaging the fastener chain of each of Example 4 and Comparative Example 6 to result in a state of the fastener stringers, and then using an Instron type tensile tester, grasping the engaging head of any one element by a jig and pulling the element at a pulling speed of 300 mm/min from the fastener tape secured to the clamp until the element was pulled out, and measuring a maximum strength at that time. The pulling direction of the element was perpendicular to the longitudinal direction of the fastener tape and parallel to the surface of the fastener tape. The measured result was an average value after measurement for 6 elements. As a result, in Example 4, a pull-out strength of 88 N was obtained, whereas in Comparative Example 6, merely a pull-out strength of 55 N was obtained.

<Discussion>

In each of Examples 1 to 6, the composition and the producing process were appropriate, so that elements having excellent strength could be produced. More particularly, Example 4 could achieve the same strength level as that of red brass. However, in Comparative Example 1, the composition ratio of Cu was lower, so that the strength comparable to that of the present invention could not be obtained. On the contrary, in Comparative Example 2, Cu was excessively added, so that the leg base portion of the element was broken during attaching to the fastener tape. In Comparative Example 3, the composition ratio of Cu was lower and Mg was excessively added, so that the strength was insufficient and breakage occurred at the time of attaching. In Comparative Example 4, Si was excessively added, so that the leg portion of the element was broken during attaching to the fastener tape. In Comparative Example 5, Ti and B were not added, so that breakage occurred at the time of attaching. Comparative Example 6 used the conventional solid solution strengthening type aluminum alloy, and it was found that the strength was poorer as compared with the present invention.

DESCRIPTION OF REFERENCE NUMERALS

1 fastener tape
2 core portion
3 element
4 upper stopper
5 lower stopper
6 slider
7 slide fastener chain
8 deformed wire having Y-shaped cross section
9 head portion
10 leg portion
11 rectangular wire
12 deformed wire having X-shaped cross section
20 element
21 leg portion
22 head portion
23 leg base portion
25 convex region

What is claimed is:

1. An element for a slide fastener, the element comprising a base material of an aluminum alloy having a composition represented by a general formula: $Al_aSi_bCu_cMg_dTi_eB_f$ in which a, b, c, d, e and f each represents % by mass; a is a balance; $0.2 \le b \le 0.8$, $0.8 \le c \le 1.8$, $0.8 \le d \le 1.8$, $0 < e \le 0.05$, and $0 < f \le 0.01$; and unavoidable impurity elements may be contained; the aluminum alloy comprising, dispersed therein, precipitates containing at least one element selected from a group consisting of Al, Si, Cu and Mg, the element for the slide fastener comprising a pair of leg portions and a head portion that connects the pair or leg portions and comprises a convex portion and a concave portion for engagement.

2. The element for the slide fastener according to claim 1, wherein the leg portions have an average Vickers hardness of from Hv 140 to Hv 170 in a leg base portion that is a region of the leg portions corresponding to 50% of a length from a base of the leg portions, the length being a length of a perpendicular line drawn from the base of the leg portions toward the tip of the leg portions.

3. The element for the slide fastener according to claim 1, wherein the leg portions have an average Vickers hardness of from Hv 145 to Hv 170 in a leg base portion that is a region of the leg portions corresponding to 50% of a length from a base of the leg portions, the length being a length of a perpendicular line drawn from the base of the leg portions toward the tip of the leg portions.

4. The element for the slide fastener according to claim 1, wherein the leg portions have an average Vickers hardness of from Hv 150 to Hv 170 in a leg base portion that is a region of the leg portions corresponding to 50% of a length from a base of the leg portions, the length being a length of a perpendicular line drawn from the base of the leg portions toward the tip of the leg portions.

5. The element for the slide fastener according to claim 1, wherein the head portion has an average Vickers hardness of from Hv 140 to Hv 170.

6. The element for the slide fastener according to claim 1, wherein a difference between an average Vickers hardness in a leg base portion and an average Vickers hardness of the head portion is within 10, the leg base portion being a region of the leg portions corresponding to 50% of a length from a base of the leg portions, the length being a length of a perpendicular line drawn from the base of the leg portions toward the tip of the leg portions.

7. The element for the slide fastener according to claim 1, wherein, when observing a cross section from a direction of viewing both of the pair of leg portions and the head portion, an average aspect ratio of crystal grains in a leg base portion is 5.1 or more, the leg base portion being a region of the leg portions corresponding to 50% of a length from a base of the leg portions, the length being a length of a perpendicular line drawn from the base of the leg portions toward the tip of the leg portions.

8. The element for the slide fastener according to claim 1, wherein the precipitates comprise at least one type selected from a group consisting of Al-Cu-Mg-based, Mg-Si-based and Al-Cu-Mg-Si-based precipitates.

9. The element for the slide fastener according to claim 8, wherein among the precipitates, the Al-Cu-Mg-based precipitates account for the highest content.

10. A slide fastener comprising the element for the slide fastener according to claim 1.

11. An article comprising the slide fastener according to claim 10.

* * * * *